US006945415B2

(12) United States Patent
Johnson

(10) Patent No.: US 6,945,415 B2
(45) Date of Patent: Sep. 20, 2005

(54) REFRIGERATED MERCHANDISING APPARATUS

(75) Inventor: Terry J. Johnson, Chicago, IL (US)

(73) Assignee: Gamon Plus, Inc., Elk Grove Village, IL (US)

( * ) Notice: Subject to any disclaimer, the term of this patent is extended or adjusted under 35 U.S.C. 154(b) by 19 days.

(21) Appl. No.: 10/757,777

(22) Filed: Jan. 15, 2004

(65) Prior Publication Data

US 2004/0144114 A1 Jul. 29, 2004

Related U.S. Application Data

(62) Division of application No. 10/334,854, filed on Dec. 31, 2002, now Pat. No. 6,701,736.

(51) Int. Cl.[7] ..... A47F 5/08
(52) U.S. Cl. ..... 211/153
(58) Field of Search ..... 211/153, 134, 211/135; 108/27; 312/408, 410; 428/26; 52/309.4

(56) References Cited

U.S. PATENT DOCUMENTS 3,080,268 A * 3/1963 Bjork ..... 428/188
3,173,826 A * 3/1965 Campbell et al. ..... 428/126
3,218,822 A 11/1965 Bently
3,606,508 A * 9/1971 Burnes ..... 312/140.3
4,308,963 A * 1/1982 Worrallo ..... 211/153
5,208,084 A * 5/1993 Rutz ..... 428/40.1
5,345,778 A 9/1994 Roberts
5,357,767 A 10/1994 Roberts
5,502,979 A 4/1996 Renard
5,809,798 A 9/1998 Clarke
5,946,933 A 9/1999 Clarke et al.

* cited by examiner

*Primary Examiner*—Sarah Purol
(74) *Attorney, Agent, or Firm*—Vedder, Price, Kaufman & Kammholz

(57) ABSTRACT

A refrigerated merchandiser including a display case and a cooling module. The display case includes a plurality of walls defining a cavity and a receptacle. A plurality of vertically spaced shelves are disposed in the cavity extending between the side walls. A display zone is defined above the top surface of each shelf for the display of merchandise. A back panel disposed in the cavity adjacent to base back wall defines a duct in a fluid communication with a plurality of elongated openings formed in the back panel. A turbulence generating element is disposed in each display zone adjacent to the elongated opening.

3 Claims, 5 Drawing Sheets

REFRIGERATED MERCHANDISING APPARATUS

CROSS-REFERENCE TO RELATED APPLICATION

This application is a divisional of application Ser. No. 10/334,854, filed Dec. 31, 2002, now U.S. Pat. No. 6,701,736 entitled "REFRIGERATED MERCHANDISING APPARATUS", having as a sole inventor, Terry J. Johnson.

BACKGROUND OF THE INVENTION

The present invention is directed to a display merchandiser, and more particularly, to an inexpensive, disposable refrigerated merchandising apparatus having improved cooling capabilities and very high load capacity shelves.

For many years now, manufacturers with temperature sensitive products, primarily food or other consumable products, have sought a means by which their merchandise may be displayed openly, yet maintained at a desired, lower than ambient temperature. One approach includes permanent refrigerated display merchandisers constructed mainly of metal. These permanent units utilize a refrigeration unit enclosed and secured within the base and a fan associated therewith to move the refrigerated air up and over the merchandise displayed therein. Generally, at least one ducted outlet adjacent the front opening of the permanent merchandisers are oriented to create an air curtain for the apparatus. Essentially, the air curtain is a column of air which descends from the upper outlet to the lower refrigeration unit intake in order to prevent the cold air from spilling out of the apparatus. Other outlets are provided for the discharge of the refrigerated air to cool the merchandise.

One disadvantage of these permanent-type apparatus is that they are very costly to use for manufacturers test marketing new products. The increased capital cost associated with a test marketing campaign often prohibits the introduction of many products.

Refrigerated merchandising display apparatus have been introduced for the test marketing campaigns. Generally, these apparatus include a housing having a receptacle for receiving a cooling module which provides refrigerated air for the merchandise. One major disadvantage of the prior art designs is that the air flow is not tightly controlled. Another disadvantage is that the construction of the housing is substandard for extended test marketing use. The housing is commonly constructed of corrugated cardboard. Wax-coated corrugated cardboard was introduced to delay the effects of liquid spills within the housing. However, prior art merchandising apparatus of this design are inferior for extended use and cannot accommodate larger packages of the merchandise because the shelves cannot handle the high weight requirements.

Therefore, there exists a need in the prior art for a refrigerated merchandising apparatus having improved strength and air flow handling characteristics which is inexpensive and disposable, if desired.

BRIEF DESCRIPTION OF THE DRAWINGS

The invention may best be understood by reference to the following description taken in conjunction with the accompanying drawings, in the several figures at which like reference numerals identify like elements.

FIG. 7 illustrates a pair of core components in accordance with one embodiment of the present invention. FIG. 8 illustrates a length of corrugated cardboard covering the oriented core components. FIG. 9 illustrates fastening opposed ends of the corrugated cardboard to the core components. FIG. 10 illustrates the composite construction of the shelf in accordance with one embodiment of the present invention.

DETAILED DESCRIPTION OF THE PREFERRED EMBODIMENTS

The refrigerated merchandiser of the present invention includes a display case and a cooling module. The display case includes a plurality of walls defining a cavity and a receptacle. The cavity is defined by a back wall, a pair of opposed side walls, a front wall, a top wall and a bottom wall. And the receptacle is defined by the back wall, the side walls, the front wall and the bottom wall. The bottom wall separates the cavity from the receptacle and includes an opening for fluid communication between the receptacle and the cavity. The receptacle is configured to receive the cooling module.

A plurality of vertically spaced shelves are disposed in the cavity extending between the side walls and include a top surface, a bottom surface and a rear surface. A display zone is defined as a volume disposed above the top surface of each shelf for the display of merchandise. A back panel is disposed in the cavity adjacent the back wall and spaced therefrom contiguous with the rear surface to define a duct in fluid communication with the bottom wall opening. The back wall includes a plurality of elongated openings, each disposed in fluid communication with the duct and one of the display zones. A turbulence generating element is disposed in each display zone adjacent the elongated opening.

A cooling module output for refrigerated air is in fluid communication with the bottom wall opening such that the refrigerated air moves through the duct and the back panel openings into contact with the turbulence generating elements which generate non-laminar air flow thereby blanketing the merchandise before falling to a return path.

In one embodiment of the present invention, a shelf for use in the refrigerated merchandiser includes a pair of foam elements, each having opposing first sides and a pair of opposing second sides. A C-channel element is connected to each first side defining a pair of core components. A length of corrugated cardboard covers the core components.

Figure 1:
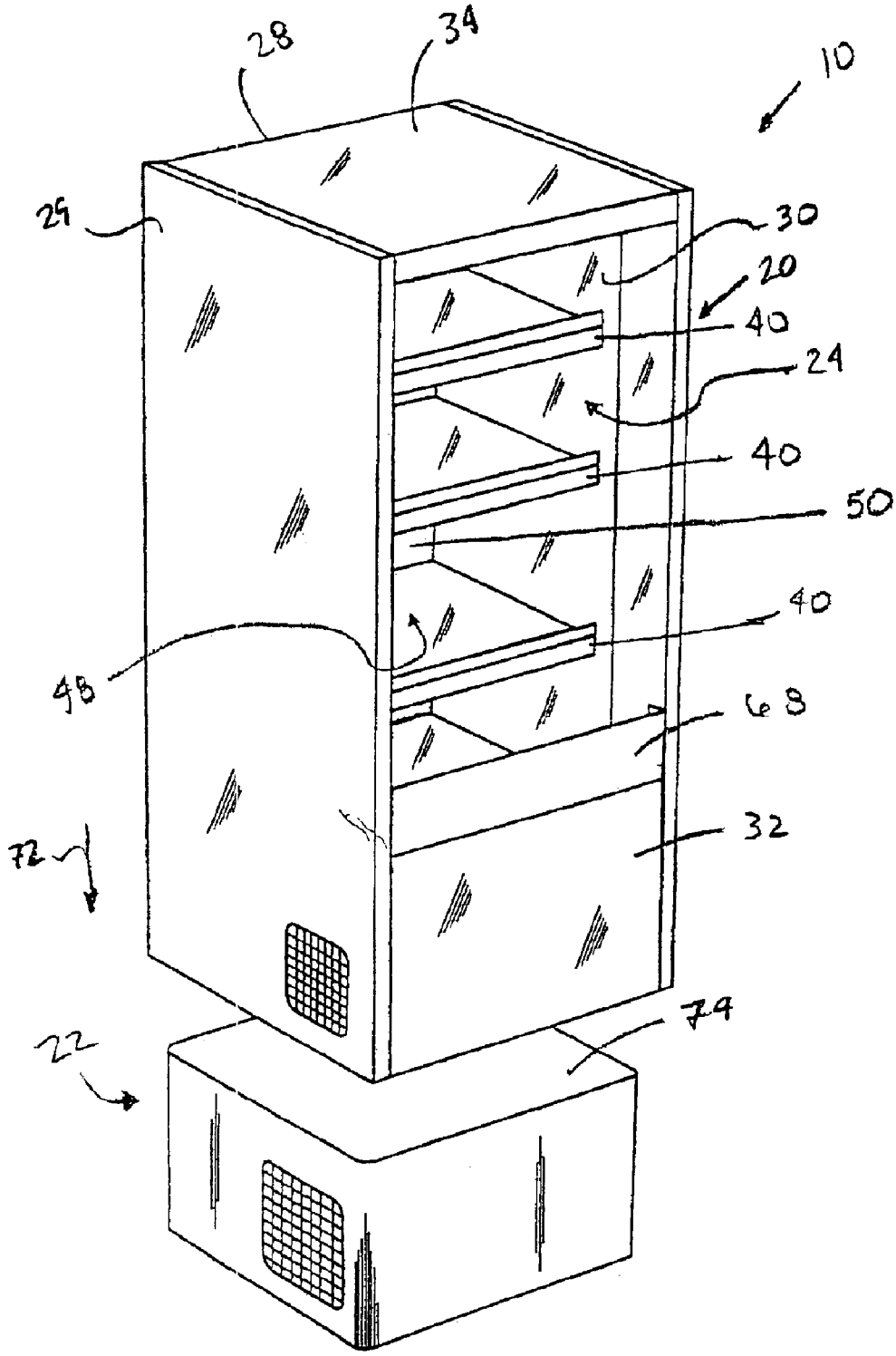
FIG. 1 is an exploded perspective view of the refrigerated merchandiser in accordance with one embodiment of the present invention.
Figure 2:
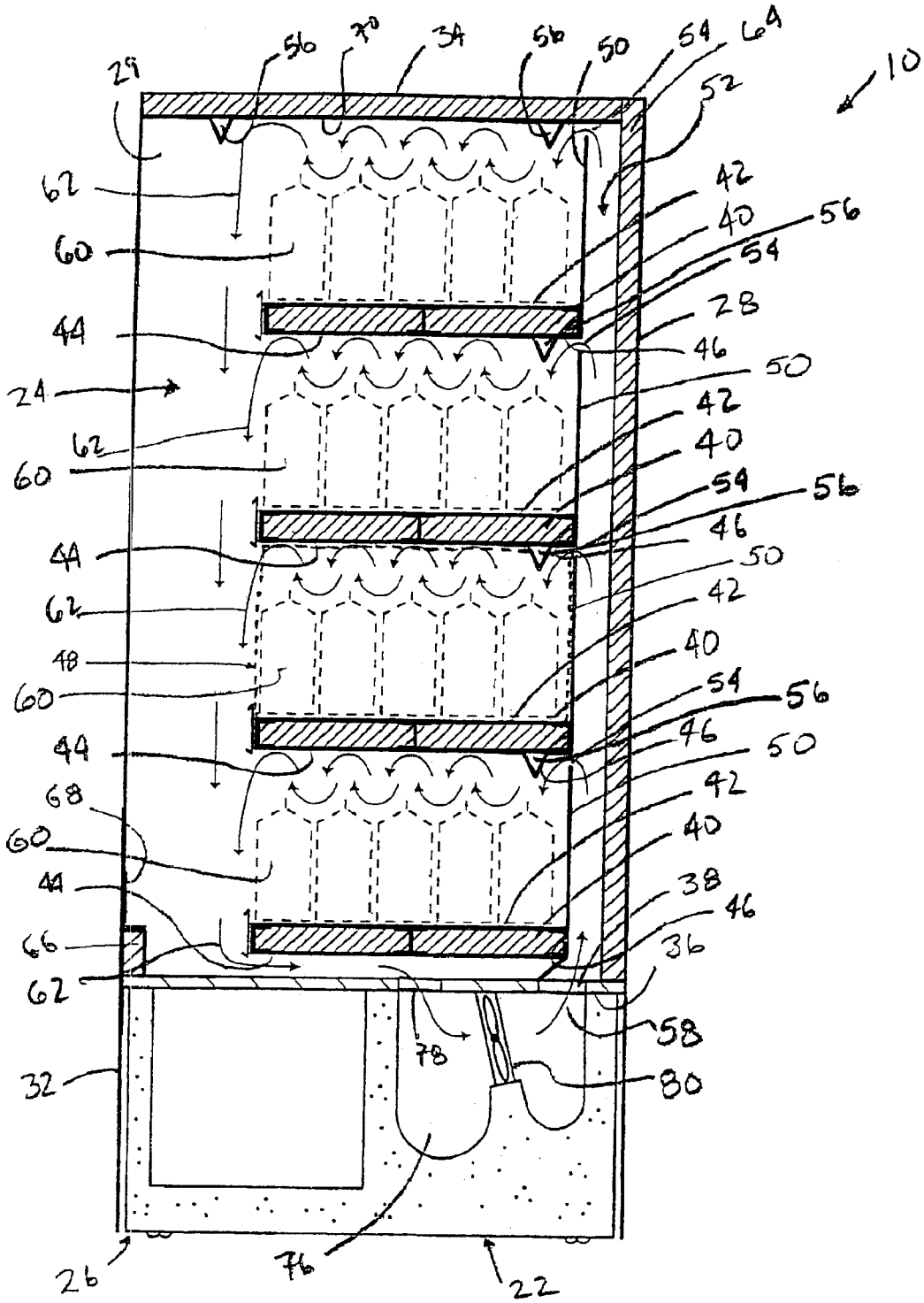
FIG. 2 is a cross-sectional view of the refrigerated merchandiser of FIG. 1 in accordance with one embodiment of the present invention.

FIG. 1 is an exploded perspective view of a refrigerated merchandiser 10 of one embodiment of the present invention. The refrigerated merchandiser 10 includes a display case 20 and a cooling module 22. The display case 20 includes a plurality of walls defining a cavity 24 and a receptacle (26, as best shown in FIG. 2). The cavity 24 is defined by a back wall 28, a pair of opposed side walls 29, 30 a front wall 32, a top wall 34 and a bottom wall 36. The receptacle 26, as better seen in FIG. 2, is defined by the back wall 28, the side walls 29, 30, the front wall 32 and the bottom wall 36 such that the bottom wall 36 separates the cavity 24 from the receptacle 26. The bottom wall 36 further includes an opening 38 for fluid communication between the receptacle 26 and the cavity 24. The receptacle 26 is configured to receive the cooling module 22.

A plurality of vertically spaced shelves 40 are disposed in the cavity 24 extending between the side walls 29, 30. As best seen in FIG. 2, the shelves each include a top surface 42, a bottom surface 44, a front surface and a rear surface 46.

A display zone 48 is defined as a volume disposed above the top surface 42 of each shelf 40 for the display of merchandise. Generally, the display zone 48 is defined as that volume above the top surface 42 of a shelf 40 and bounded at the top by an adjacent shelf 40 or top wall 34 and at the sides by the respective opposed side walls 29, 30. The front of the display zone 48 is unbounded and generally defined by the front surface of the shelf 40. A back panel 50 defines a boundary of the rear of the display zone 48.

The back panel 50 is disposed in the cavity 24 adjacent the back wall 28 and spaced therefrom contiguous with the rear surface 46 of each shelf 40 to define a duct 52 in fluid communication with the bottom wall opening 38. The back panel 50, as best seen in FIG. 2, includes a plurality of elongated openings 54 disposed in fluid communication with the duct 52 and each of the display zones 48. A turbulence generating element 56 is disposed in each display zone 48 adjacent the elongated opening 54.

A cooling module output for refrigerated air 58 is in fluid communication with the bottom wall opening 38 such that the refrigerated air, indicated by the arrows, moves through the duct 52, through the back panel openings 54 and into contact with the turbulence generating elements 56 which generate non-laminar flow above the merchandise 60. The refrigerated air flow is thereby slowed down so that the merchandise 60 is blanketed with refrigerated air before the air flow falls to a return path, generally indicated by arrow 62.

In one embodiment of the present invention, the back wall 28, side walls 29, 30, top wall 34 and shelves 40 have a composite construction. Preferably, the composite construction includes at least a foam element and corrugated cardboard elements.

The back wall 28, sides walls 29, 30 and top wall 34 preferably have a composite construction wherein the corrugated cardboard is connected to an exterior surface of the foam element. In another embodiment of the present invention, an additional corrugated cardboard element may be connected to an interior surface of the foam element. It is within the teachings of the present invention that the corrugated cardboard element referred to herein may also include any corrugated cardboard having a coating applied thereto to resist moisture. Such coating may be any suitable coating used in the art. For example, the coating may be a wax, plastic or any other suitable element.

Referring to FIG. 2, in one embodiment of the present invention, the foam element 64 of the back wall 28 does not extend below the bottom wall 36. It is within the teachings of the present invention, however, that if additional strength is required, the foam element 64 may extend the full length of the cardboard element. The side walls 29, 30 are also similarly constructed. The front wall 32 in this embodiment primarily includes a cardboard element and a smaller foam element 66 disposed contiguous with the bottom wall 36 to support the transparent panel 68.

In this embodiment of the present invention, each back panel elongated opening 54 extends substantially between the side walls 29, 30. Further, each elongated opening 54 is disposed adjacent the top boundary of the display zone 48. The turbulence generating elements 56, in this embodiment, are disposed in the display zones 48 adjacent the elongated opening 54.

At least one shelf 40 has the turbulence generating element 56 connected to the bottom surface 44 thereof. Preferably, a turbulence generating element 56 is connected to the bottom surface 41 of each shelf 40 other than a lower-most shelf. Further, the top wall 34 includes an inner surface 70 having the turbulence generating element 56 connected thereto. In one embodiment of the present invention, the turbulence generating elements 56 are generally vertically aligned.

In another embodiment of the present invention, the top wall 34 includes a second turbulence generating element 56 disposed on the inner surface 70 spaced from the first turbulence generating element 56 adjacent the front-boundary of the display zones.

It is within the teachings of the present invention that all other walls of the display case 20 may be constructed in a composite manner as described above. In one embodiment of the present invention, the bottom wall 36 is constructed of plywood or other suitable material.

In operation, the refrigerated merchandiser 10 is lowered into position over the cooling module 22 in the direction of arrow 72 such that the bottom wall 36 is supported by a top surface 74 of the cooling module 22. The cooling module 22 is connected to a conventional power source such as an electrical wall outlet in order to activate operation of the cooling unit 22. Air is drawn into the cooling portion 76 of the cooling module 22 through opening 78. The cooling area 76 of the cooling module 22 is shown as a schematic representation as the structure and operation thereof are conventional in the art. After the air has been appropriately cooled, a fan 80 further redirects the air from the cooling module output through the bottom wall opening 38 into the duct 52 for distribution throughout the display case 20.

The refrigerated air flow moves up the duct 52 and is discharged generally as laminar air flow through the elongated openings 54 into contact with the turbulence generating element 56 disposed adjacent the elongated opening 54 in the respective display zone 48. The turbulence generating elements 56 disrupt the laminar flow of the air discharged from the elongated openings 54 such that the airflow tumbles across the merchandise 60 as shown by the arrows in FIG. 2. As a result, the refrigerated air flow is considerably slowed so that the merchandise may be blanketed with the refrigerated air before falling to a return path 62.

The second turbulence generating element 56 disposed on the inner surface 70 of the top wall 34 aids in redirecting the air flow from the top shelf 40 in the direction of a return path 62. The resulting downward air flow urges air exiting from lower display zones 48 to also enter the return path 62. The transparent panel 68 helps retain the air flow within the display case 20 such that it may be recirculated as explained above.

Figure 3:
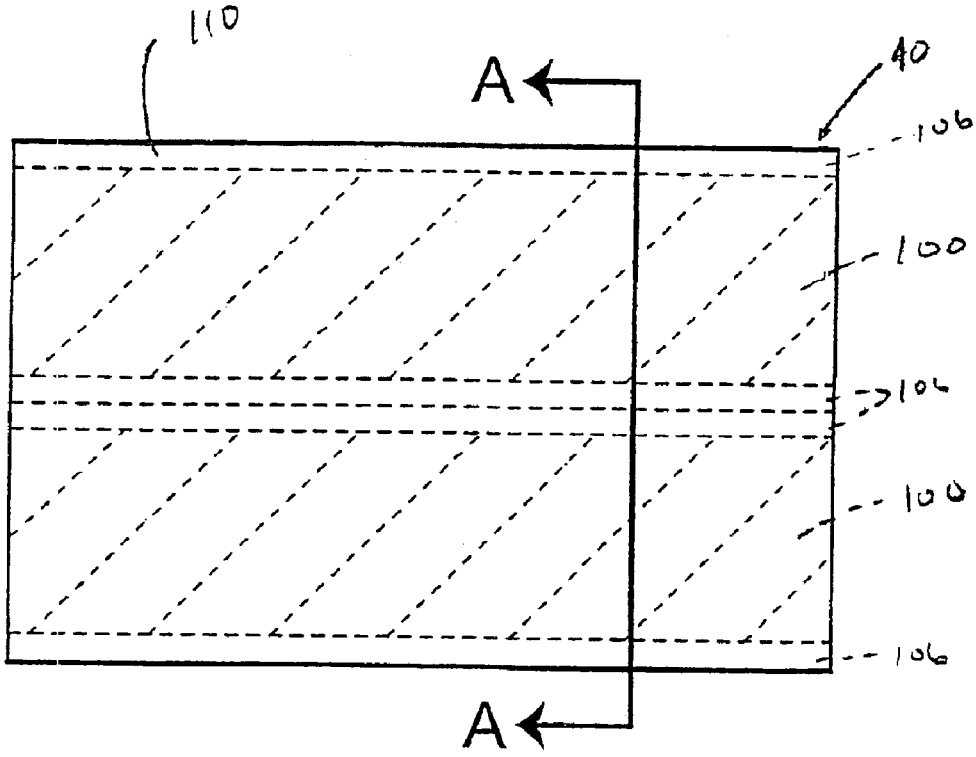
FIG. 3 is a top plan view of a shelf in accordance with one embodiment of the present invention.
Figure 4:
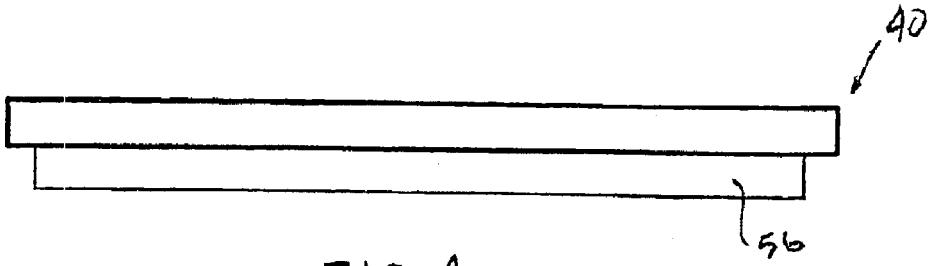
FIG. 4 is a front elevation view of the shelf of FIG. 3 in accordance with one embodiment of the present invention.
Figure 6:
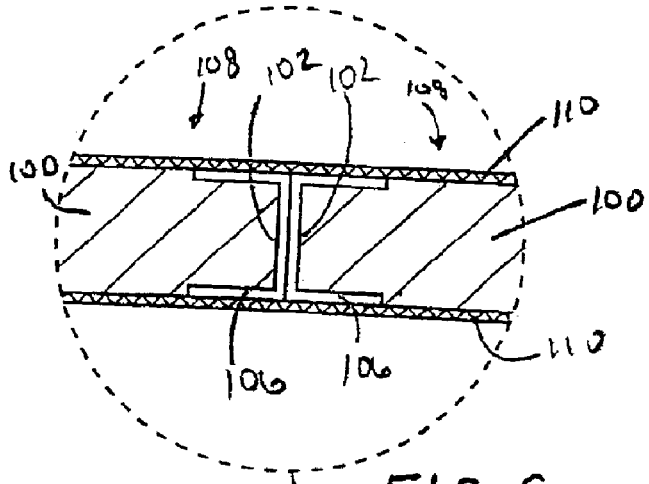
FIG. 6 is a detailed view of a highlighted portion of the shelf of FIG. 5 in accordance with one embodiment of the present invention.

Referring now to FIGS. 3–10, a shelf 40 in accordance with one embodiment of the present invention is shown and discussed. FIG. 3 is a top plan view of the shelf 40 in accordance with one embodiment of the present invention.

Figure 7:
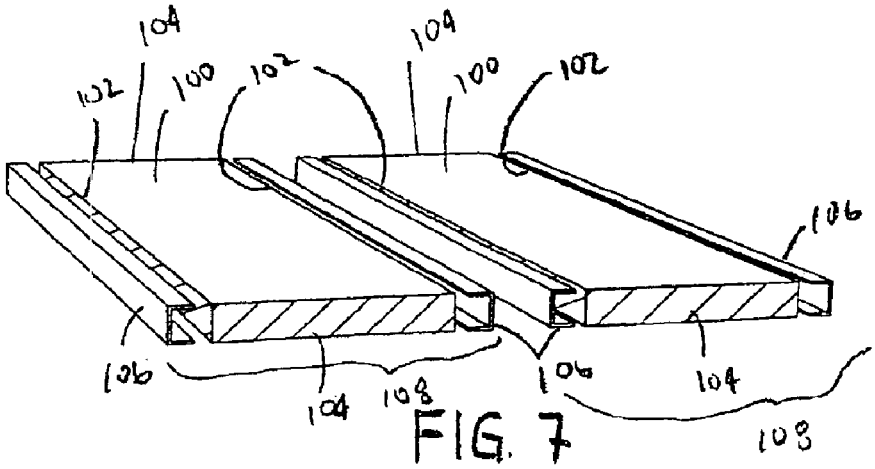
FIGS. 7–10 illustrate the sequential steps for constructing a shelf in accordance with one embodiment of the present invention.

As better illustrated in FIG. 7, the shelf 40 includes a pair of foam elements 100 each having a pair of opposing first sides 102 and a pair of opposing second sides 104. It will be apparent to those of skill in the art that the opposed first sides are generally referred to as the long sides of the foam elements 100 and the opposing second sides 104 are generally referred to as the short sides of the foam elements 100. However, it is within the teachings of the present invention that the first sides are equal in the extent or longer than the second sides. The C-channel element 106 is connected to each first side thereby defining, in this embodiment, a pair of core components 108.

Figure 8:
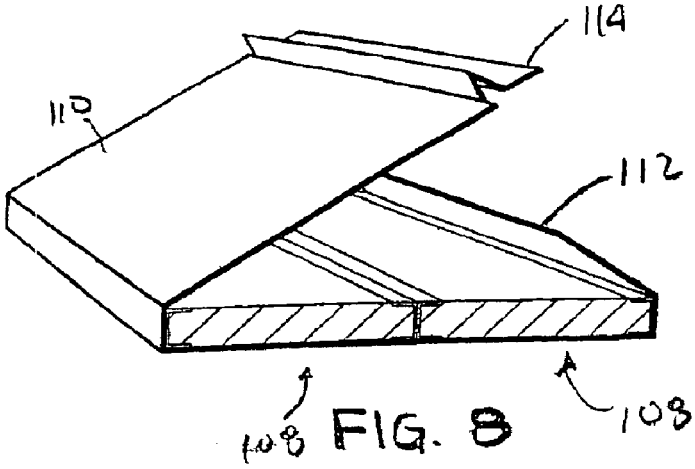
Figure 9:
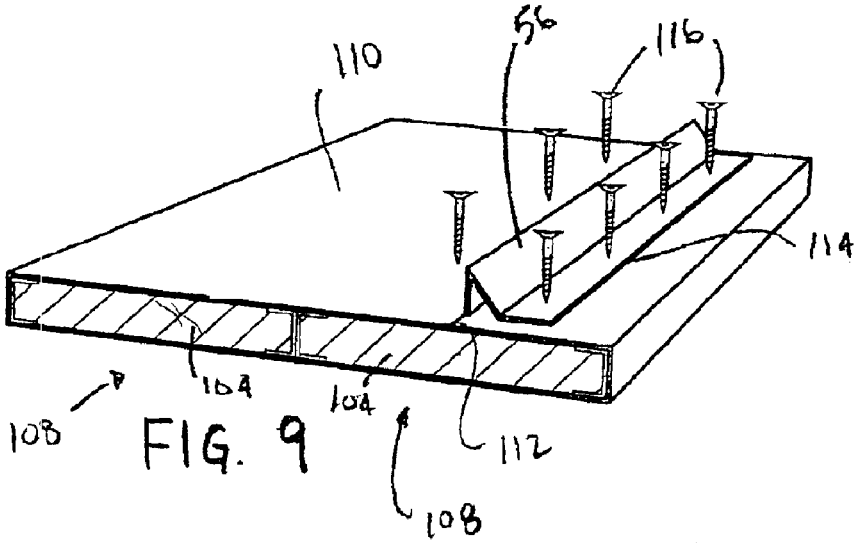
Figure 10:
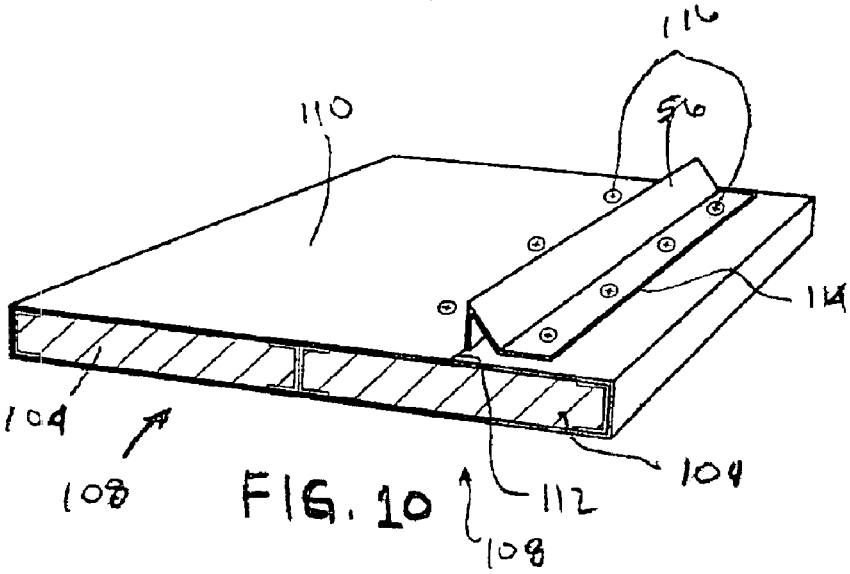

As best shown in FIG. 8, a length of corrugated cardboard 110 covers the core components 108. The length of corrugated cardboard 110 includes opposed ends 112, 114 which overlap when covering the core components 108, see FIGS. 9 and 10. Preferably, in one embodiment of the present invention, the overlapping opposed ends 112, 114 are connected to the core components 108 by threaded fasteners 116. It is within the teachings of the present invention that any other suitable fastening or connecting device, method or apparatus may be used. For example, rivets, pushpins, adhesives, two-part fasteners, hook-and-loop fasteners or any other suitable mechanism or method.

FIGS. 4, 5, 9 and 10, each illustrate various different views of the turbulence generating element 56 are formed in the length of corrugated cardboard 110 between the overlapping opposed ends 112, 114. It is within the teachings of the present invention that the turbulence generating elements 56 may be formed separately from the length of corrugated cardboard 110 and connected to the shelf 40 as desired.

Figure 5:
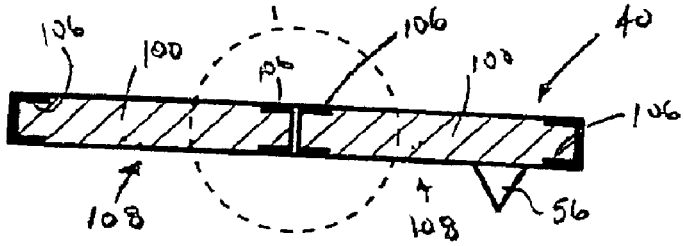
FIG. 5 is a cross-sectional view of the shelf of FIG. 3 taken along line A—A of FIG. 3.

FIG. 5 is cross-sectional view of the shelf of FIG. 3 taken along the line A—A illustrating the shelf 40 in accordance with one embodiment of the present invention. As better illustrated in the detailed view of the FIG. 6, the core components 108 are disposed such that the respective first sides abut one another. The adjacent C-channel elements 106, which have been fitted to the first sides 102 of the foam elements 100 are disposed in an abutting back-to-back relationship. Preferably, the C-channel elements 106 snugly fit the first sides 102 of the foam elements 100 without the need for fastening devices or methods. However, it is within the teachings of the present invention that any suitable fastening device or method may be used as desired.

The method of constructing a very high load capacity yet lightweight shelf, in accordance with one embodiment of the present invention, for use in a refrigerated merchandiser includes the steps of: (1) providing a pair of elongated foam elements 100, each having a pair of opposed first sides 102 and a pair of opposed second sides 104; (2) attaching a C-shaped channel element 106 to each first side to define a pair of core components (see FIG. 7); (3) orienting the core components such that the core components abut along first sides thereof; (4) covering the abutting core components 108 with a length of corrugated cardboard 110 having opposed ends 112, 114 such that one of the opposed ends 114 overlaps the other 112 (see FIG. 8); and (5) connecting the opposed ends 112, 114 of the length of corrugated cardboard to the core components 108 such that the second sides 104 are uncovered (see FIGS. 9 and 10). It is within the teachings of the present invention that the step of covering the core components includes using threaded fasteners 116 or any other suitable fastening means.

The invention disclosed herein is not limited to the particularly details of the apparatus depicted and modifications and applications maybe contemplated. For example, the materials described herein maybe substituted with any other suitable or less expensive materials which are suitable for the intended use. For example, various structures and configurations maybe used for the compositely formed shelves of the present invention. Certain other changes may be made in the above described apparatus with allowed to bargain from the true spirit and still of the invention here involved. Is intended, therefore that the subject matter of the above depiction shall be interpreted as illustrated and not in a limiting sense.

What is claimed is:

1. A shelf for use in a refrigerated merchandiser comprising:

a pair of foam elements, each having a pair of opposing first sides and a pair of opposing second sides;

a channel element connected to each first side defining a pair of core components; and a length of corrugated cardboard covering the core components wherein the length of corrugated cardboard includes opposed ends which overlap when covering the core components.

2. The shelf as recited in claim 1, wherein the overlapping opposed ends are connected to the core components by threaded fasteners.

3. The shelf as recited in claim 1, wherein a turbulence generating elements is formed in the length of corrugated cardboard between the overlapping opposed ends.

* * * * *